United States Patent [19]

Bainton et al.

[11] 4,186,485

[45] Feb. 5, 1980

[54] OPENER HAVING SEAM GRIPPING MEANS

[75] Inventors: Donald J. Bainton, Kenilworth; Carmen T. Mascia, Clarendon Hills, both of Ill.

[73] Assignee: The Continental Group, Inc., New York, N.Y.

[21] Appl. No.: 923,884

[22] Filed: Jul. 12, 1978

[51] Int. Cl.[2] ..... B67B 7/30

[52] U.S. Cl. ..... 30/410; 30/443

[58] Field of Search ..... 30/410, 443, 445, 446; 220/267, 277, 278

[56] References Cited

U.S. PATENT DOCUMENTS

| | | | |
|---|---|---|---|
| 1,813,620 | 7/1931 | Henry | 30/445 |
| 1,991,247 | 2/1935 | Hamlin | 30/446 |
| 2,349,128 | 5/1944 | Akers | 220/277 |
| 2,784,488 | 3/1957 | Olson | 30/446 |
| 3,079,683 | 3/1963 | Carew | 30/410 X |
| 3,172,478 | 3/1965 | Giclas | 220/278 X |

*Primary Examiner*—Gary L. Smith
*Attorney, Agent, or Firm*—Charles E. Brown

[57] ABSTRACT

A container opener particularly adapted for opening a container wherein the end wall of the container is provided with a preformed line of weakness. The opener includes a cover which functions as a temporary closure and has depending therefrom an annular blade for effecting rupture along the line of weakness. A magnet is centrally located with the blade for retaining the cutout end wall portion. The opener may include a housing having means for interlocking beneath the double seam securing an end unit to a container body, or it may have arms which are interlockable with the double seam.

8 Claims, 3 Drawing Figures

OPENER HAVING SEAM GRIPPING MEANS

This invention relates in general to new and useful improvements in container opening means, and more particularly to an opener arrangement particularly adapted for use in conjunction with conventional cans having steel end units.

While many improvements in opening devices for cans have been developed in recent years, including the formation of easy opening end units wherein opening is effected by pulling on a suitable tab, there still remains a demand for relatively inexpensive cans suitable for use in packaging products such as food products. At the present time, end units for such cans must be opened with a can opener of a type which includes a blade for initiating the opening operation and a drive mechanism engageable with the double seam to effect relative motion between the blade and the end unit. Manual openers of this type are difficult to actuate, and as a result most openings of steel end cans are now effected by electric can openers. Even electric can openers have difficulties functioning with respect to all types of cans due to the inability to effectively grasp the double seam in a manner required to effect rotation of the can relative to a fixed blade. Further, conditions do not always exist where the utilization of an electric can opener is feasible.

In accordance with this invention, it is proposed to provide a steel end unit wherein the end panel thereof is provided with a peripheral line of weakening, preferably formed by scoring. This line of weakening defines the opening line of the end unit.

It is proposed to provide an opener which when seated on an end unit will grip the double seam securing the end unit to the container body and permit the use of a lever actuated cam to effect the forcing of a blade through the end wall in alignment with the line of weakening formed therein. In one form of the invention, a simple housing is provided with the housing having a skirt portion telescoped over and interlockable beneath the double seam. In another form of the invention, there is a pair of gripping arms which are pivotally mounted relative to a lever so that the action of the lever may first draw the arms tightly into interlocked engagement with the double seam followed by further movement of the lever to effect a camming of the blade through the end wall.

With the above and other objects in view that will hereinafter appear, the nature of the invention will be more clearly understood by reference to the following detailed description, the appended claims, and the several views illustrated in the accompanying drawings.

Figure 1:
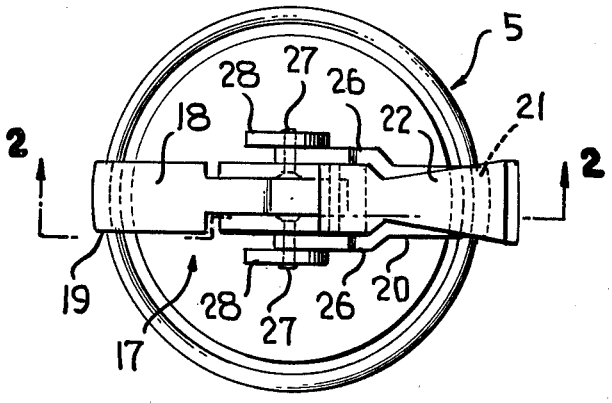
FIG. 1 is a plan view of a can having an end unit formed in accordance with this invention and with there being mounted on the end unit a first form of opener in accordance with this invention.

Referring now to the drawings in detail, it will be seen that there is illustrated a container 5 which includes a body 6 having a suitable closure 7 at the bottom end thereof, and a further closure or end unit 8 at the top thereof. The closure 8 is secured to the body 6 by a double seam 9, and includes an end wall or end panel 10. The end wall or end panel 10 is provided with a line of weakness 11, preferably in the form of a score, which line of weakness defines a removable panel portion 12.

In accordance with this invention, there is provided an opener which in its basic form includes a lid or cover 14 having depending therefrom a blade 15. A magnet 16 overlies the central portion of the cover 14.

Although the blade is illustrated as being of a constant height, it is feasible that the blade may be tapered in height so that there will be a gradual rupture of the end wall 10 along the line of weakness.

The opener comprising the cover 14, the blade 15, and the magnet 16, forms a part of an overall opener device generally identified by the numeral 17. The opener device, broadly speaking, must include means for gripping beneath the double seam 9 and must also have cam means for urging the cover 14 downwardly toward the end wall 10.

Figure 2:
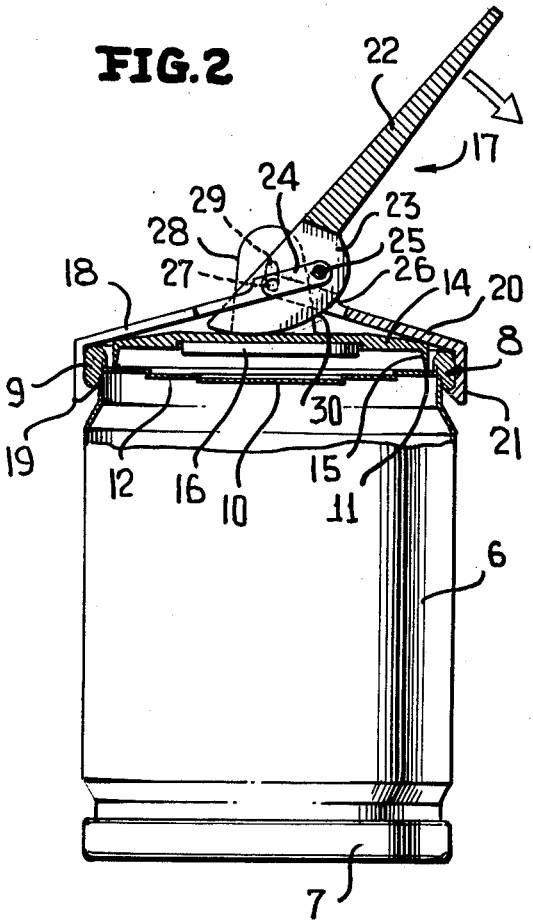
FIG. 2 is a side elevational view of the can and opener of FIG. 1, with the upper portion of the can and the opener being shown in section, the section being taken generally along the line 2—2 of FIG. 1.

The opener device 17 includes a first arm 18 having a depending gripping portion 19 configurated to grasp the double seam 9, as is best shown in FIG. 2. The opener device also includes a second arm 20 having a depending gripper portion 21, also adapted to grasp and interlock beneath the double seam 9.

The opener device 17 also includes a handle or lever 22 having a bifurcated lower end portion 23. The arm 18 has a reduced width terminal portion 24 which extends into the bifurcated portion 23 and is pivotally connected thereto by a pivot pin 25.

The arm 20 has a bifurcated inner end portion 26 which straddles the bifurcated portion 23 of the lever 22 and is connected to the lever 22 by means of two separate but aligned pins 27.

It is to be noted that the pins 25 and 27 are so arranged that the arms 18 and 20 are in crossing relation, and thus when the lever 22 is moved in a clockwise direction (FIG. 2), the arms 18, 20 are drawn together so as tightly to grip the double seam 9.

The cover 14 is generally suspended from the lever 22 by means of a pair of upstanding supports 28 disposed outwardly of the arm portions 26. The supports 28 have slotted openings 29 receiving outer ends of the pins 27.

Further, as is best shown in FIG. 2, the bifurcated portion 23 of the lever 22 has the shape of or incorporates a cam 30. Thus, when the lever 22 reaches the position of FIG. 2 wherein the blade 15 is resting on the end wall 10 in alignment with the score 11 and the arms 18, 20 have initiated a gripping action on the double seam 9, further rotation of the lever 22 in a clockwise direction will result in the cam 30 urging the cover 14 downwardly to force the blade 15 through the end wall 10 and thus sever therefrom the removable panel portion 12. The severed removable panel portion 12 will be restrained by the magnet 16 and thus will be removed with the opener device 17.

It is also to be noted that the cover 14, overlying the removable panel portion 12, will also function as a general closure to prevent splashing of the product within the container 6. Normally the container 6 will have packaged therein food products such as fruit and the like.

Figure 3:
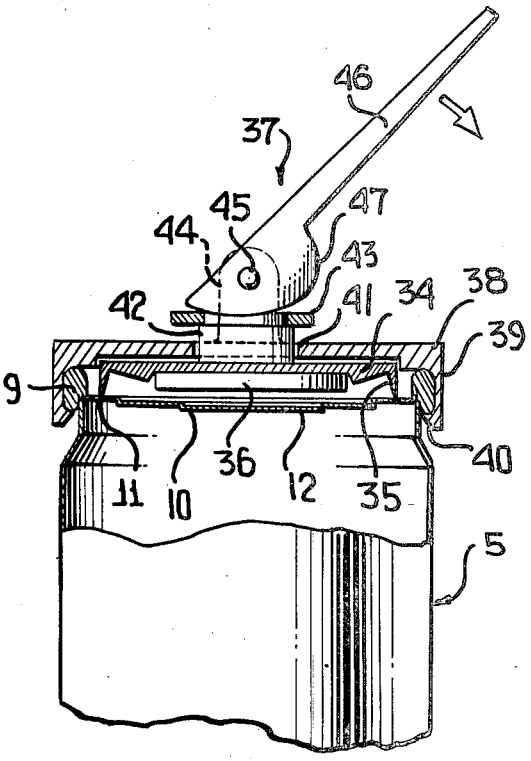
FIG. 3 is a fragmentary side elevational view of a can seam of the can of FIGS. 1 and 2, with the upper portion thereof being shown in section and having mounted thereon a modified form of opener.

Reference is now made to FIG. 3 wherein the same container 5 is illustrated, and there is associated therewith a slightly modified form of opener but still including a lid or cover 34 having a depending blade 35 and carrying a magnet 36. This modified form of opener is part of an opener device generally identified by the numeral 37. The opener device 37 includes a housing 38 having a depending skirt 39 terminating in a gripping rim 40. The housing 38 is formed of a suitable material, including plastics materials, and is snappable into place seated on and interlocked with the double seam 9 of the container 5. The position of the housing 38 on the container 5 will result in the automatic alignment of the blade 35 with the line of weakness 11 in the end wall 10.

The housing 38 has a central guide bore 41 therethrough in which a stem 42 extending upwardly from the cover 34 is guidingly engaged. The stem 42 has an enlarged head 43 which retains the cover 34 and housing 38 in assembled relation.

The housing 38 has extending upwardly therefrom a pair of spaced-apart ears or supports 44 which carry a pivot pin 45 on which there is pivotally mounted a lever or handle 46. That portion of the lever 46 adjacent the pivot pin 45 is in the form of a cam 47 which is engageable with the stem 42 in a manner so as to depress the cover 34 and the blade 35 carried thereby when the lever 46 is rotated in a clockwise direction from its position of FIG. 3.

Although only two preferred embodiments of the opener device have been specifically illustrated and described, it is to be understood that minor variations may be made in the opener devices without departing from the spirit and scope of the invention as defined by the appended claims.

We claim:

1. An opener particularly adapted for opening prescored end units of cans secured to can bodies by an end seam, said opener comprising a retainer adapted to overlie an end unit of a can and having means for interlocking engagement with an end seam of a can, a separately formed cover carried by said retainer for overlying an end unit, a blade depending from said cover for movement therewith relative to said retainer and being centered relative to said retainer for alignment with a score in the end unit to be opened, said blade having a circular free edge and actuator means connected to said retainer and said cover for applying a force on said cover urging said cover axially away from said retainer toward an underlying end unit.

2. The opener of claim 1 together with a magnet carried by said cover within the confines of said blade for retaining a severed end unit portion.

3. The opener of claim 1 wherein said retainer is in the form of a closure, and said actuator includes a cam pivotally mounted relative to said closure.

4. The opener of claim 3 wherein said cover has a stem extending axially through said closure in guided relation, and said cam is engageable with said stem.

5. The opener of claim 1 wherein said retainer is in the form of seam gripper arms, and said actuator means also defines means for drawing said seam gripper arms together to grip an end seam from below and prevent upward movement of said gripper arms.

6. The opener of claim 5 wherein said cover is suspended from said actuator means, and said actuator means includes a cam pivotally mounted relative to both said cover and said gripper arms.

7. The opener of claim 6 wherein the relationship of the connection of said actuator means to said seam gripper arms and said cover provides for a simultaneous radial inward drawing of said seam gripper arms and axial movement of said cover.

8. The opener of claim 1 wherein said opener is seated on a can having a prescored end unit including a circular score defining a removable panel portion.

* * * * *